US005619946A

United States Patent [19]

Wallasch

[11] Patent Number: 5,619,946

[45] Date of Patent: Apr. 15, 1997

[54] SAIL FURLING DEVICE WITH BEARINGS TO PERMIT SIMULTANEOUS CABLE AND EXTRUSION ROTATION

[76] Inventor: Lutz Wallasch, 1036 Archer Pl., Baldwin, N.Y. 11510

[21] Appl. No.: 564,627

[22] Filed: Nov. 29, 1995

[51] Int. Cl.[6] ..... B63H 9/04

[52] U.S. Cl. ..... 114/106; 114/39.1; 384/618

[58] Field of Search ..... 114/102, 103, 114/105–108, 39.1; 384/618, 623

[56] References Cited

U.S. PATENT DOCUMENTS

| | | | |
|---|---|---|---|
| Re. 29,279 | 6/1977 | Fretwell | 114/104 |
| 700,145 | 5/1902 | Larned | 384/618 |
| 1,334,266 | 3/1920 | Simmins | 384/623 |
| 3,835,804 | 9/1974 | Jackson | 114/107 |
| 4,057,023 | 11/1977 | Hood | 114/107 |
| 4,061,101 | 12/1977 | Cook | 114/106 |
| 4,122,793 | 10/1978 | Molz | 114/106 |
| 4,250,826 | 2/1981 | Katshen | 114/106 |
| 4,267,790 | 5/1981 | Hood | 114/106 |
| 4,267,791 | 5/1981 | Ingouf | 114/106 |
| 4,449,468 | 5/1984 | Schultz | 114/104 |
| 4,567,839 | 2/1986 | Foresman | 114/102 |
| 4,646,670 | 3/1987 | Jamieson | 114/102 |
| 4,723,499 | 2/1988 | Furgang | 114/106 |
| 4,724,787 | 2/1988 | Chevalier | 114/107 |
| 4,848,258 | 7/1989 | Priebe | 114/103 |
| 4,972,789 | 11/1990 | Greppi | 114/90 |
| 5,080,033 | 1/1992 | Valiant | 114/104 |

FOREIGN PATENT DOCUMENTS

| | | | |
|---|---|---|---|
| 8300665 | 9/1984 | Netherlands | 114/106 |

*Primary Examiner*—Edwin L. Swinehart
*Attorney, Agent, or Firm*—Alfred M. Walker

[57] ABSTRACT

A maritime sail furling mechanism furls a sail around a rotating luff extrusion from an open to a furled position in a natural fashion while functioning under load. A novel bearing assembly, including upper and lower bearing portions, accommodates static and horizontal loads, and rotates with both the luff extrusion and the sail cable wire. The sail boat mainsail furling and unfurling device includes a rotatable cable with the luff extrusion, around which extrusion the mainsail is wound while the sailboat is under motor power. Each upper and lower bearing portion includes several cylindrical hollow members, one middle member of these members freely rotates as a collar about a circular array of tapered roller bearings placed with their tip ends at a center of a sunburst pattern cage. The tapered roller bearings rotate axially, but their spherical heads, located away from the center of the array, rotate about the circumferential collar. In contrast to present day furling systems wherein a stationary cable has the tendency to interrupt the sail furling process by rubbing against the interior of the hollow extrusion, under the bearing assembly of the present invention, the cable wire is allowed to rotate with the extrusion, thereby eliminating wear, friction and the distortion associated with the prior art furling systems.

11 Claims, 8 Drawing Sheets

18
17
13
15
16
14
11
7
8
6
13
9
2
8a
7a
11a
14a
15a
16a
6
17a
6
18a
40
8b
10
41
13

9
9
11a
34'
33
14a
34
33'
31
15a
16a
17a
13
17a'
18a'
28a
30
27a
18a"
32
18a
40a
40c
40d
40

Fig. 6
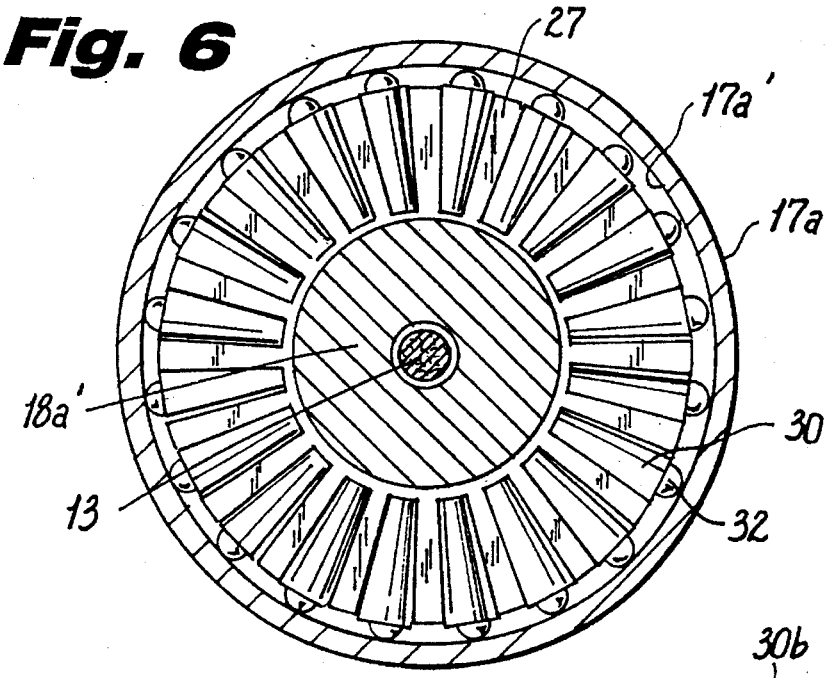
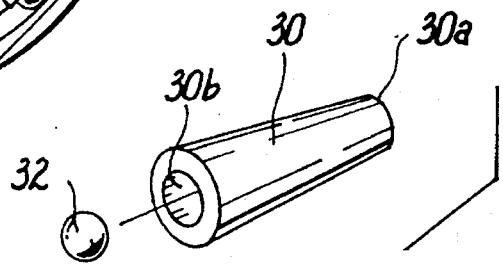
Fig. 7
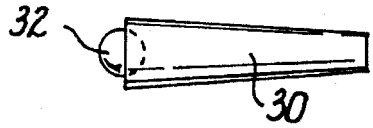
Fig. 8
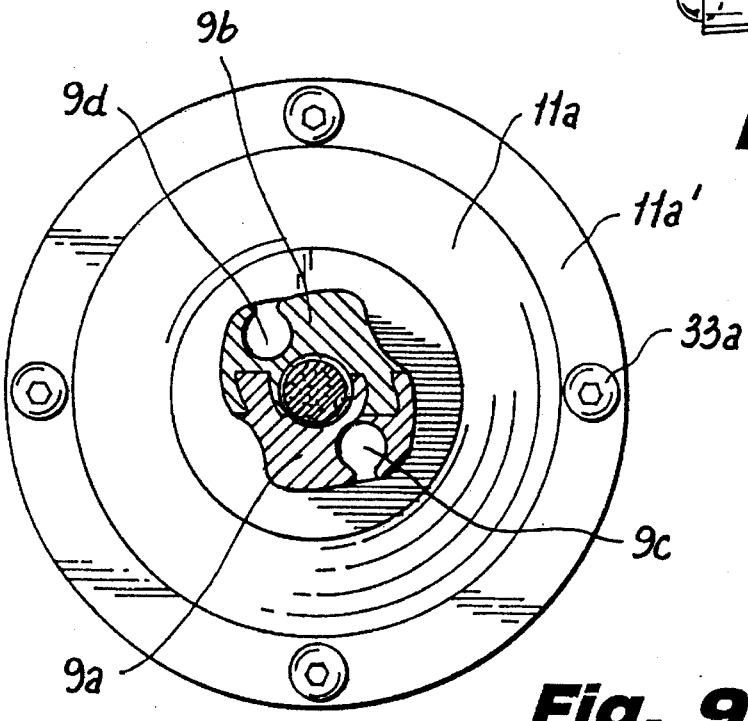
Fig. 9

SAIL FURLING DEVICE WITH BEARINGS TO PERMIT SIMULTANEOUS CABLE AND EXTRUSION ROTATION

FIELD OF THE INVENTION

The present invention relates to a maritime sail furling mechanism which furls a sail around a rotating luff extrusion from an open to a furled position in a natural fashion while functioning under load. A novel bearing assembly accommodates static and horizontal loads, and rotates with both the luff extrusion and the sail cable wire.

The cable wire of the sail boat mainsail furling and unfurling device rotates within the rotatable luff extrusion, and the mainsail is wound around the extrusion while the sailboat is under motor power.

The bearing portion includes several cylindrical hollow members, one middle member of these members freely rotates as a circumferential collar race ring about a circular array of tapered roller bearings placed with their tip ends at a center of a sunburst pattern cage. To provide thrust, the tapered roller bearings rotate axially. Each tapered roller bearing has a concave head to accommodate a spherical ball bearing, which rotates against the inside surface of the collar race ring, located away from the center of the array.

DESCRIPTION OF THE PRIOR ART

Various attempts have been made to furl sails, such as mainsails or jibs, about an extrusion rod or a boom. However, modern mast furling systems generally include a cable wire surrounded by a hollow extrusion rod to which the sail is attached. The extrusion rotates, thereby allowing the sail to be deployed or reefed. However, the disadvantage of most such furling systems is that the cable wire remains stationary within the hollow extrusion. When the extrusion is under bending load, such as during moderate wind, the hollow extrusion itself will bend, causing the internally located stationary cable wire to chafe and rub against the interior of the hollow extrusion, causing wear, friction, distortion and failure of the extrusion rotation under wind load.

Among the existing prior art patents for furling devices include U.S. Pat. No. 4,723,499 of Furgang, which discloses a segmented furling system with movable extrusion segments and a stationary cable for jib sails for sailboats.

U.S. Pat. No. 4,061,101 of Cook describes a sail furling apparatus with a fixed core cable.

U.S. Pat. No. 4,724,787 of Chevalier discloses a device for furling a sail of a ship on a boom.

U.S. Pat. No. 4,449,468 of Schulz discloses an adjustable roller furling spar for furling a sail around a boom.

U.S. Pat. No. 4,267,790 of Hood describes a sail furling mechanism wherein a rotatable inner mast is provided with a hollow mast for facilitating the furling of the mainsail within the hollow mast. U.S. Pat. No. 4,057,790 of Hood also describes a sail furling mechanism wherein a rotatable inner mast is provided to permit the furling of the mainsail within the hollow mast.

U.S. Pat. No. 4,267,791 of Ingouf discloses jib roller systems with stationary cables.

U.S. Pat. No. 4,567,839 of Foresman describes a furling system for furling a sail inside a hollow mast.

U.S. Pat. No. 4,646,670 of Jamieson describes a sail mast and boom mechanism for sail boarding vessels.

U.S. Pat. No. 4,122,793 of Molz discloses a mainsail furling device wherein the mainsail is furled around a wire extending substantially parallel to the mast.

U.S. Pat. No. 4,848,258 of Priebe describes an airfoil sail system.

U.S. Pat. No. 4,972,789 of Greppi describes a sail furling system wherein the sail is furled around a mandrel within a fixed hollow mast.

U.S. Pat. No. 5,080,033 of Valiant describes an accessory line for furling a spinnaker sail.

U.S. Pat. No. Re. 29,279 reissue of Fretwell describes a hoisting mechanism for a spinnaker sail including a plurality of rings which extend the length of the sail to allow the sail to remain furled when being raised.

OBJECTS OF THE INVENTION

It is an object of the present invention to provide a sail furling system which can effectively operate under wind load.

It is also an object of the present invention to provide a sail furling mechanism having a rotatable cable wire within a longitudinally extending extrusion.

It is yet an object of the present invention to provide a sail furling cable wire which can be shipped rolled on a spool.

It is a further object of the present invention to provide a main sail furling system including a rotatable cable wire surrounded by an extrusion to which the sail is attachable.

It is also an object of the present invention to provide a sail furling extrusion which rotates in conjunction with a cable wire stay, thereby allowing the sail to be deployed or reefed.

It is furthermore an object of the present invention to allow a sail furling extrusion to rotate with a cable wire therein, without wear, friction, distortion and failure, under wind load.

It is a further object to provide a bearing system for a sail furling device wherein the cable wire is allowed to rotate in conjunction with a longitudinally extending rotating extrusion, thereby eliminating wear, friction and distortion of the wire during furling.

It is yet another object to provide a sail furling system capable of reefing while under load, to prevent premature failure of the drum and bearings.

It is yet another object to improve existing sail furling systems with a sail furling system which will outperform all current furling systems.

It is a further object of the present invention to avoid excessive loads created when the sail is attempted to be furled under load, wherein the wire and the luff extrusion are in conflict with one another.

It is yet another object to provide a rotating luff extrusion for a sail to be wrapped around which avoids an additional curve to the revolving geometry.

It is yet another object to provide a furling system which will function under load, with a new bearing assembly which is accommodating to the static and horizontal loads, by rotating the bearings, cable wire, and luff extrusion.

It is yet another object to minimize luff curvature of an extrusion about which extrusion the main sail is to be wound, due to the static wire loading.

It is yet another object to provide a bearing system assembly, in conjunction with a rotating cable wire and a luff extrusion, where the mainsail can be gently furled from an open, unfurled position in a steady manner to a closed, furled position, and by reversing this procedure, can be gently moved from a furled position to open, unfurled position.

It is also an object of the present invention to improve over the disadvantages of the prior art.

SUMMARY OF THE INVENTION

In keeping with these objects and others which will become apparent, the present invention includes a maritime sail furling mechanism which furls a sail around a rotating luff extrusion from an open to a furled position in a natural fashion while functioning under load. A novel bearing assembly accommodates static and horizontal loads, and rotates both the luff extrusion and the sail cable wire stay simultaneously.

The sail boat mainsail furling and unfurling device includes a rotatable cable wire rotating in conjunction with the luff extrusion, around which extrusion the mainsail can be effectively wound around a spindle, or spool, by manually pulling upon the furling rope, while the sailboat is under motor power.

The bearing assembly preferably includes an upper bearing portion at the top of the mast and a lower bearing portion attached to the mast at a lower part thereof. Each bearing portion includes several cylindrical hollow members. One middle member of these members freely rotates as a collar race ring about a circular array of rotatable, horizontally oriented tapered roller bearings placed with their tip ends at a center of a sunburst pattern roller cage. The tapered roller bearings rotate axially to promote thrust. Within the concave heads of the tapered roller bearings, located away from the center of the array, include spherical ball bearings which rotate against the inside of the circumferential collar race ring.

Modern mast furling systems consist of a wire surrounded by an extrusion to which the sail is attached. The extrusion rotates thereby allowing the sail to be deployed or reefed. With most existing systems, the wire is stationary and the various methods of allowing the extrusion to rotate around the wire cause wear, friction, distortion and often failure, especially under wind load.

Using the bearing assembly of the present invention, the wire is allowed to rotate with the extrusion, thereby eliminating wear, friction and the distortion associated with the other systems. The present invention works better than a solid rod furling system, while providing unexpected beneficial results.

In contrast to present day furling systems wherein a stationary cable has the tendency to interrupt the sail furling process by rubbing against the interior of the hollow extrusion, with the bearing assembly of the present invention, the cable wire is allowed to rotate with the luff extrusion, thereby eliminating wear, friction and the distortion associated with the prior art furling systems.

Moreover, because the cable wire can be rotated, it can be shipped rolled on a spool, in contrast to the prior art solid cable wire rods, which take up considerable linear length and often must be disassembled into two or three parts for shipping purposes.

To permit rotation of the cable wire in conjunction with the hollow luff extrusion, the bearing assembly may include a drum, a rotating device such as a motor or hand crank and drum assembly, etc. and attachments to attach the furling system to the mast. A motor may also drive the cable wire within the generally vertical hollow extrusion.

The remainder of the stow-away furling system includes the hardware needed to attach and install the furling system to a mast. Alternatively, the system may optionally include a hydraulic cylinder to pre-load the cable wire stay.

Existing furling systems, otherwise known as sail storage systems, currently should be capable of reefing while under load. Typically they cannot. A roller furling system will sometimes work under load but the practice is not recommended as the premature failure of the drum and bearings is usually the result.

Recognizing a need to improve existing head stay systems but identifying a need for stow away roller systems adjacent to the mast, the present invention outperforms current furling systems.

The performance of the furling device of the present invention solves inherent problems associated with the current state of the art roller furling systems, which are caused by friction, which friction manifests itself as "load". Furthermore, prior attempts to use ball bearings or torlon ball bearings have created more problems, given their application.

For example, excessive loads to the current furling technology are created when the sail is attempted to be furled under wind load. When under wind bending load, a straight wire within a bending luff extrusion are in conflict with one another. Rotating the extrusion around a fixed wire under load imposes an additional unwanted curve to the revolving geometry of the extrusion and the fixed wire.

Additionally, roller balls used in the prior art drum assemblies, which rotate freely when relaxed, actually act as a brake when rotating especially under load. Rotating roller balls contact the outer edge of the race, which contact is self-defeating to their circular motion during rotation.

In response to the above mentioned pre-existing friction problems of the prior art furling devices, and to create a furling system which will function under load, the present invention includes a new bearing assembly which accommodates both static and horizontal loads, and which rotates the entire mass of its bearings, in conjunction with the rotating cable wire, and the rotating extrusion surrounding the rotating cable wire.

As a result, there is provided a true working furling system which will work under any load. Therefore, the furling system of the present invention has all the benefits of a solid rod system and none of the negatives.

Primarily designed as a stow away system for a main sail, the present invention can also be used as a head sail furler with obvious advantages to the current systems.

An added benefit is the minimization of luff curvature due to the static wire loading, as set when initially installed, or with the incorporation of a hydraulic cylinder to control luff tension in either configuration.

A key inventive feature is a twin bearing system assembly, used in conjunction with the rotating cable wire and luff extrusion, where the mainsail can be gently furled from an open, unfurled position in a steady manner to a closed, wrapped furled position, and by reversing this procedure, can be gently moved from a furled position to an open, unfurled position.

The twin bearing assembly preferably includes two bearing portions, an upper bearing portion and a lower bearing portion, which portions are attached to the rotating cable at the top and bottom respectively. The rotating cable wire extends from the hand held crank and drum, or motor, through the hollow extrusion to the top of the mast for the mainsail.

Moreover, the rotating cable wire is attached to the hand crank and drum, or motor, if motorized.

To permit rotation, the cable wire rotates within a hollow extrusion. The extrusion rotates within upper and lower rotatable bearing race plates of the respective twin bearing portions.

Adjacent to each upper and lower bearing race plate is provided a sunburst pattern roller cage having therein a centrally located cylindrical ring member. The inside surface of the ring member of the roller cage rotates freely about a cylindrical protrusion extending from each bearing race plate. Radially extending arms radiate uniformly out from the inner ring of each top and bottom roller cage, and the arms are separable by recesses, within which recesses lie rotatable tapered truncated roller bearings.

The tapered roller bearings increase in width from an inner proximal end to an outer distal end. The outer distal ends are concave to receive spherical roller bearings therein.

The spherical roller bearings rotate both within the respective concave surfaces of the tapered roller bearings, as well as against an inner surface of a freely rotatable outer race ring, also adjacent to the bearing race plate. The outer race ring rotates against a base plate of a stationary cylindrical bearing housing opposite the side of the outer race ring which rotates against the bearing race plate.

The lower stationary cylindrical bearing housing near the bottom of the mast is attached by a bracket to the boom on one side and by a further bracket to the mast. The upper stationary cylindrical bearing housing is attached by a bracket to the mast near its top.

Positioned within each stationary cylindrical main housing are vertically oriented needle roller bearings, which rotate between an inside surface of each cylindrical housing and an outside surface of the smaller cylindrical protrusion extending from the rotating bearing race plate. The opposite ends of the vertically oriented needle bearings nest between the base plate of the main housing at one end, and a further base bearing plate attached to a truncated conical cap within which cap the extrusion rotates.

While the sail furling luff extrusion may be a hollow cylinder, preferably, the extrusion preferably includes two molded vertically extending pieces which each contain a concave surface, which concave surfaces, when joined together, form a nesting tube through which extends the rotatable cable wire.

In operation, the furling system is a mechanical sail furling device designed for use on sail boats. The furling system has a rotatable spindle or spool about which the furling rope sheet rotates, allowing the user to pull the furling rope around the spindle in a friction reduced, stabilized manner with a feeling of security. The device easily returns the sail to a furled position around the luff extrusion even when under wind load.

It is primarily designed to be used by an ambulatory sailor who steers a sailboat at the same time, without difficulty.

The spool has been designed to incorporate an optional motorized furling motor, which can be installed on the furling spindle.

In summary, the present invention furls a sail to the furled position, about the longitudinally extending extrusion and the present invention has a twin bearing assembly at both the top and bottom of the extrusion, so that the cable wire attached to the sail rotates with equal force at both the top and bottom ends.

DESCRIPTION OF THE DRAWINGS

The sail furling mechanism, according to the present invention, will be better understood with the aid of the following drawing figures, in which:

FIG. 6 is a top plan view of the roller cage of the bearing portion of the sail furling mechanism as in FIG. 3.

FIG. 7 is a perspective view of a tapered roller bearing of the roller cage as in FIG. 6.

FIG. 8 is a side elevational view of the tapered roller bearing as in FIG. 7.

FIG. 9 is a cross sectional view of the extrusion and cable portion of the sail furling mechanism as in FIG. 2.

DETAILED DESCRIPTION OF THE EMBODIMENT

Figure 1:
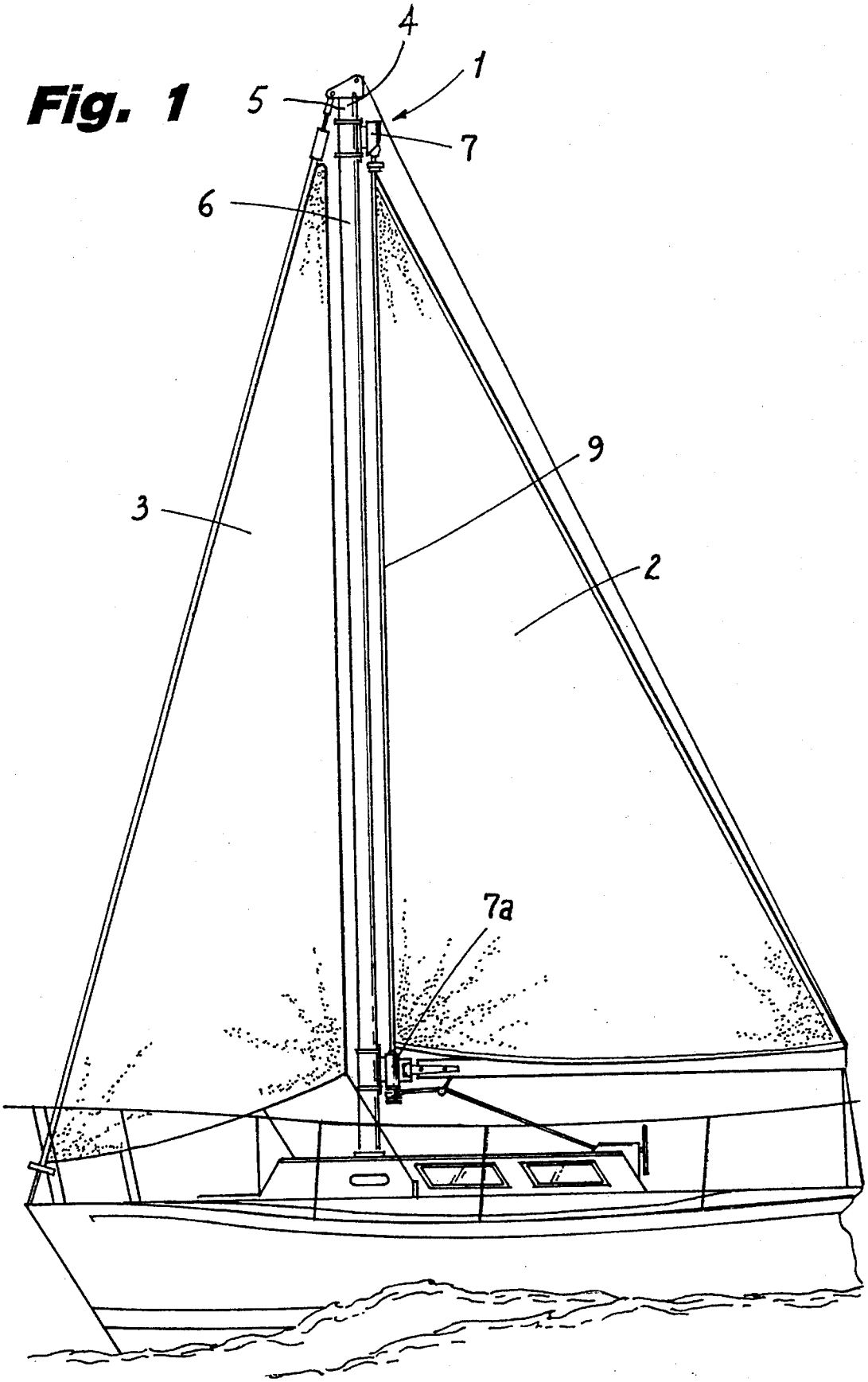
FIG. 1 is a side elevational view of a sailboat utilizing the sail furling mechanism of the present invention.
Figure 2:
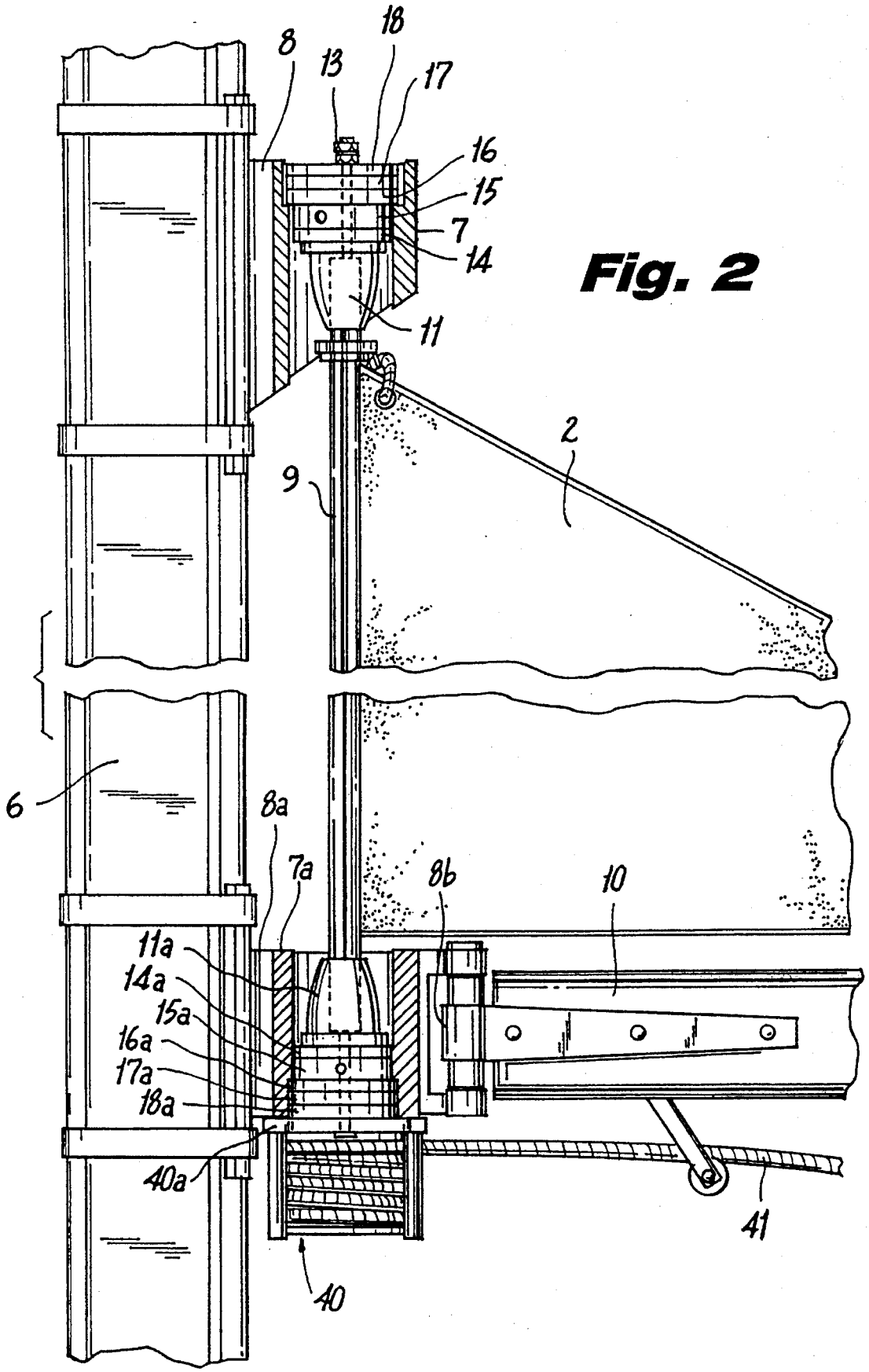
FIG. 2 is a side elevational view in cross section of the top and bottom bearing mechanisms of the present invention.
Figure 3:
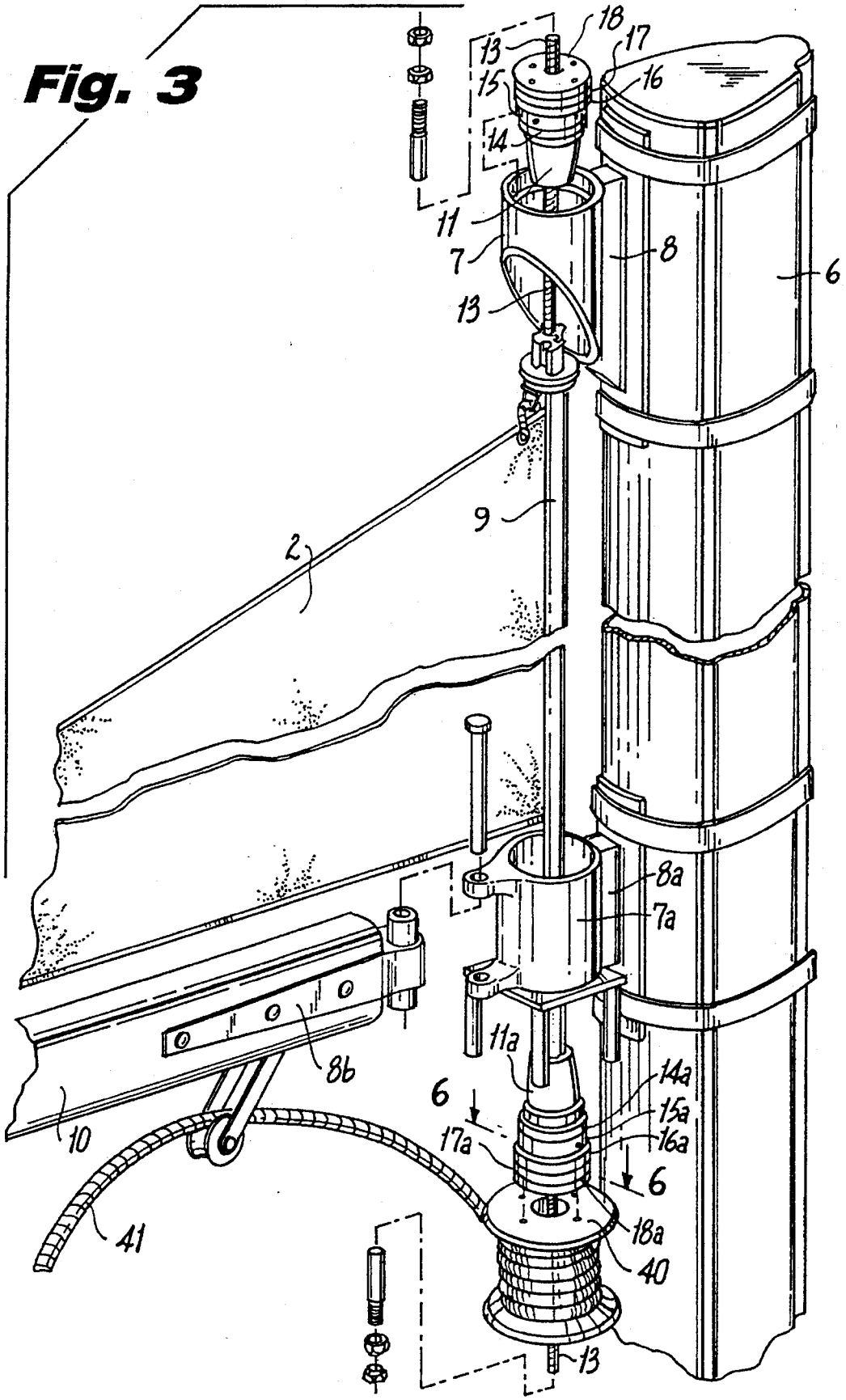
FIG. 3 is a perspective view of the sail furling mechanism as in FIG. 2.

As shown in FIGS. 1–11, maritime sail furling and unfurling mechanism 1 of the present invention is provided for a sailboat having main sail 2 and jib 3. Sail furling mechanism furls main sail 2 around a hollow vertically oriented, longitudinally extending rotating luff extrusion 9 having therein a rotating cable wire, from an open to a furled position in a natural fashion even while functioning under wind load.

A pair of corresponding top and bottom bearing portions 7, **7*a* accommodate static and horizontal loads, which bearing portions 7, 7*a* rotate in conjunction with both luff extrusion rod 9 and sail cable wire 13** therein.

As shown in FIG. 9, sail boat mainsail furling and unfurling mechanism 1 preferably includes longitudinally extending luff extrusion 9, preferably having two interlocking extrusion portions **9*a*, 9*b*. Mainsail 2 is wound around extrusion 9, while the sailboat is under motor power. Luff extrusion portions 9*a*, 9*b* each contain respective longitudinally extending recesses 9*c*, 9*d*, within which recesses 9*c* or 9*d* the sail edge of sail 1 is placed, for raising or lowering of sail 1 within recess 9*c* or recess 9*d* of extrusion 9**.

In contrast to present day furling systems wherein a stationary cable has the tendency to interrupt the sail furling process by rubbing against the interior of the hollow extrusion, under the bearing system of the present invention, cable wire 13 is allowed to rotate with extrusion 9, thereby eliminating wear, friction and the distortion associated with the prior art furling systems.

Mainsail 2 is furled from an open, unfurled position in a steady manner to a furled, wrapped position, and by reversing this procedure, is moved from a furled position to an open, unfurled position.

Figure 10:
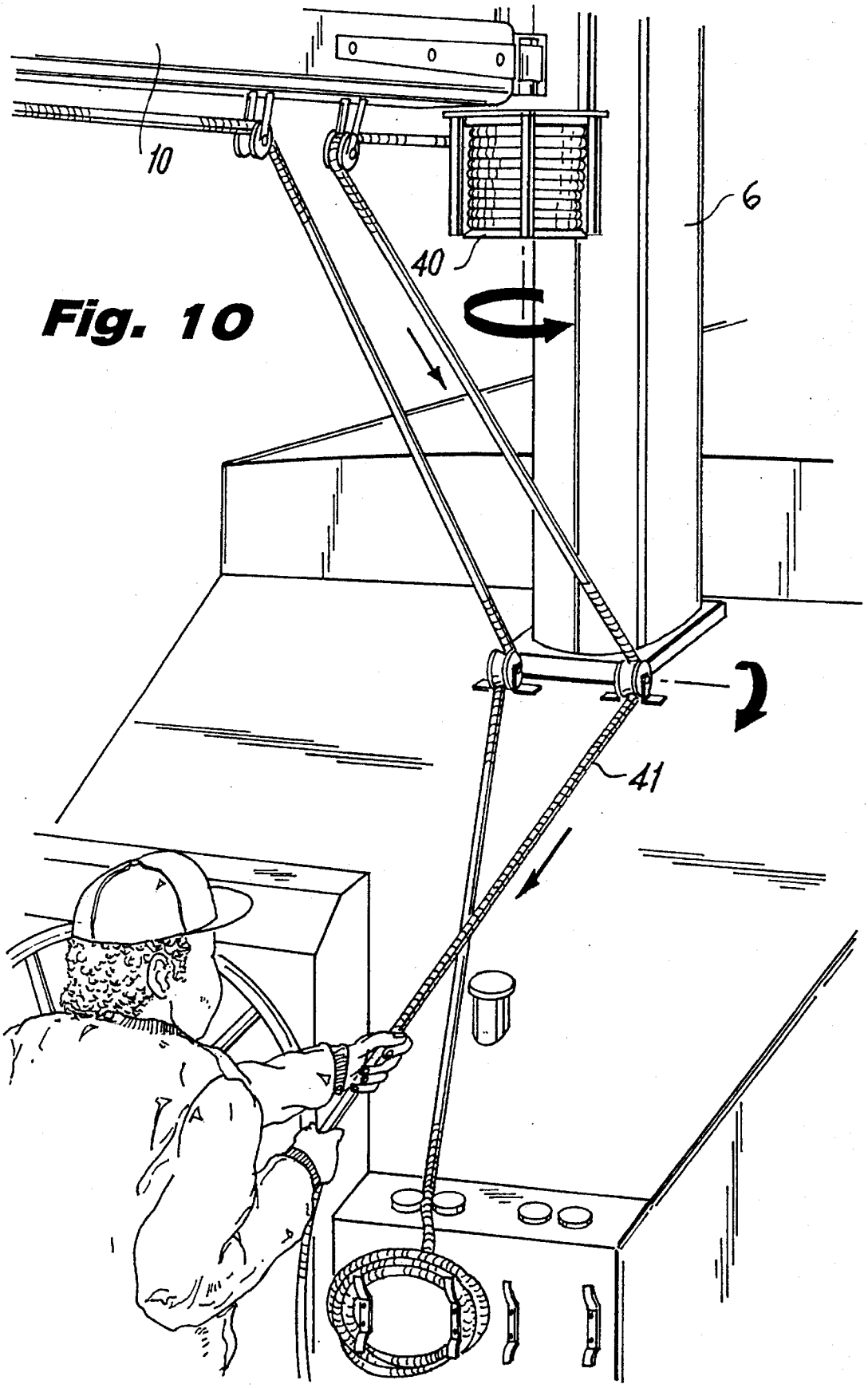
FIG. 10 is a perspective view of the bottom portion of the sail furling mechanism, shown in use.

As shown in FIG. 10, the bearing assembly, including bearing portions 7, **7*a*, for rotating cable wire 13, is attached to a hand crank and drum, having a spindle 40 about which spindle furling rope 41** is wound and may be pulled manually by the user.

To permit rotation, cable wire 13 is rotated within extrusion 9, which extrusion 9 straddles cable wire 13 within it to further facilitate rotation. The user pulls furling rope 41 around spool 40 to rotate extrusion 9 and upper and lower twin bearing mechanisms 7, 7*a*, which are basically mirror images of each other.

Figure 4:
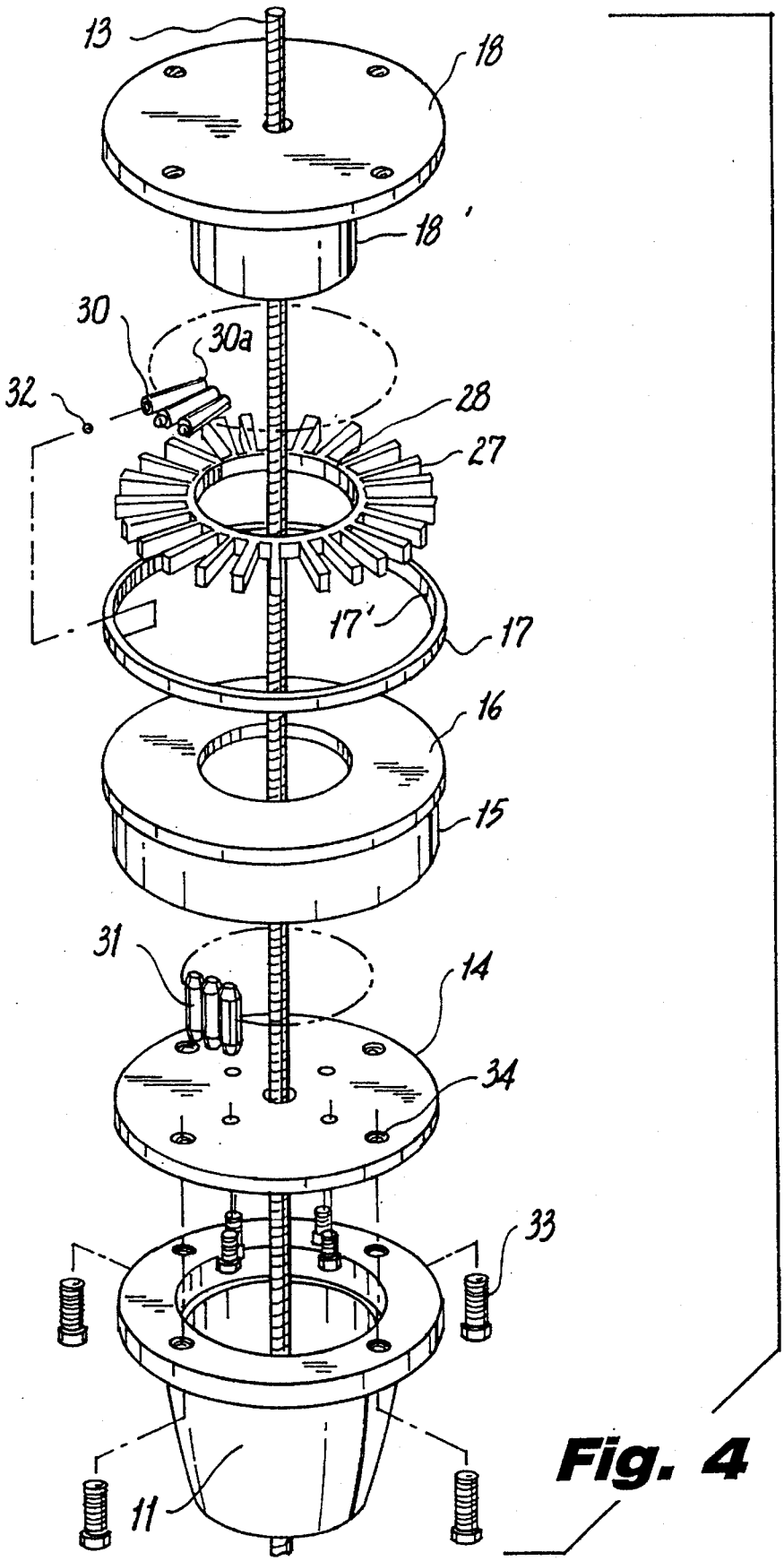
FIG. 4 is an exploded close up perspective view of the top bearing portion of the sail furling mechanism as in FIG. 2.
Figure 5:
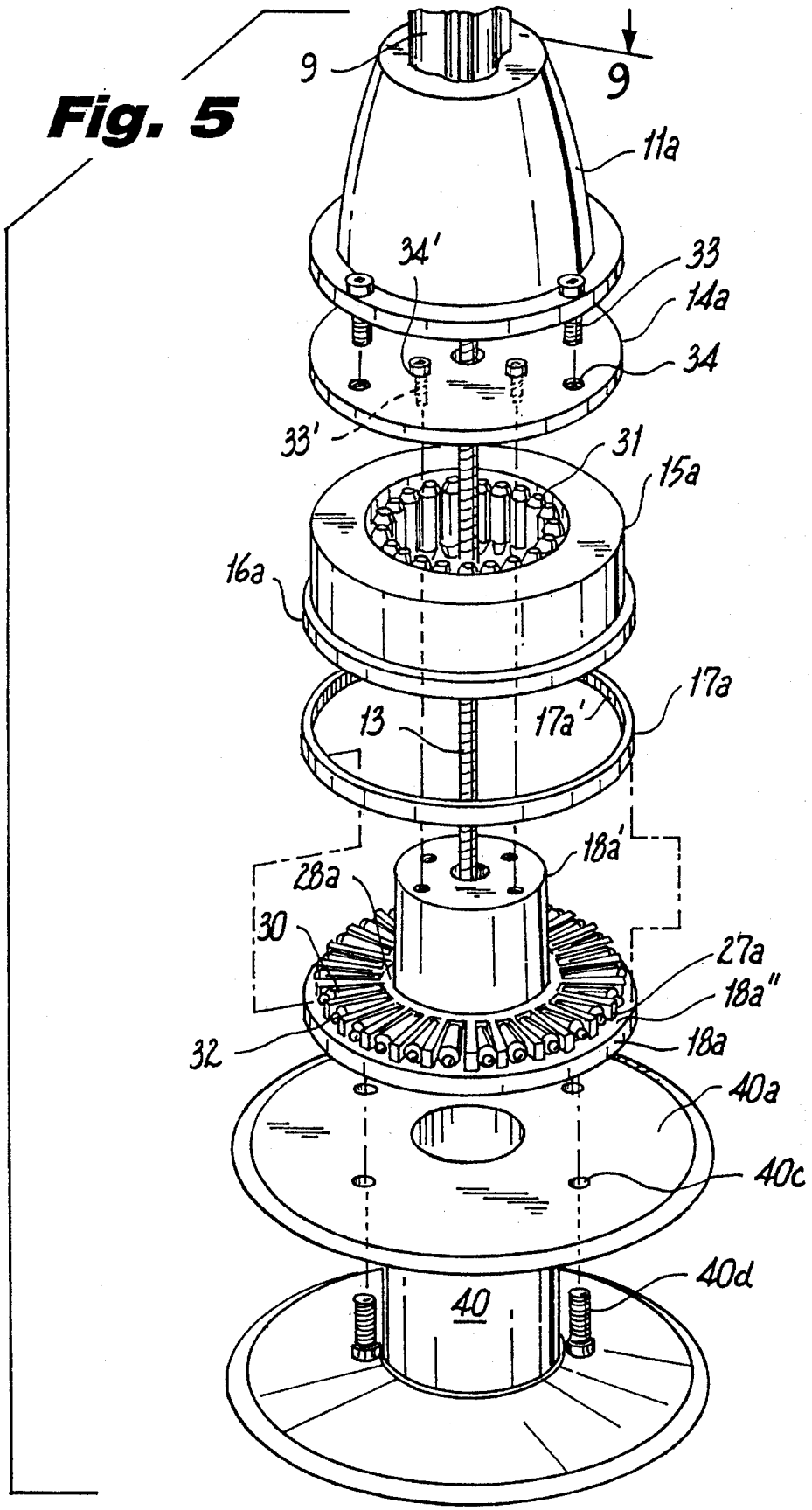
FIG. 5 is an exploded close up perspective view of the bottom bearing portion of the sail furling mechanism as in FIG. 2.

For example, as shown in FIG. 4, the top of upper bearing portion 7 includes hollow bearing plate 18, whereas as shown in FIG. 5, the bottom of lower bearing portion includes hollow bearing plate 18*a*, attached to the top of spool 40.

Upper bearing portion 7 is located near masthead 4 at the top 5 of mast 6. Lower bearing portion 7*a* is located near the bottom of mast 6, adjacent to boom 10. Upper bearing portion 7 is attached to mast 6 by upper bracket 8, and lower bearing portion 7*a* is attached to mast 6 and boom 10 by brackets 8*a* and 8*b* respectively.

Figure 11:
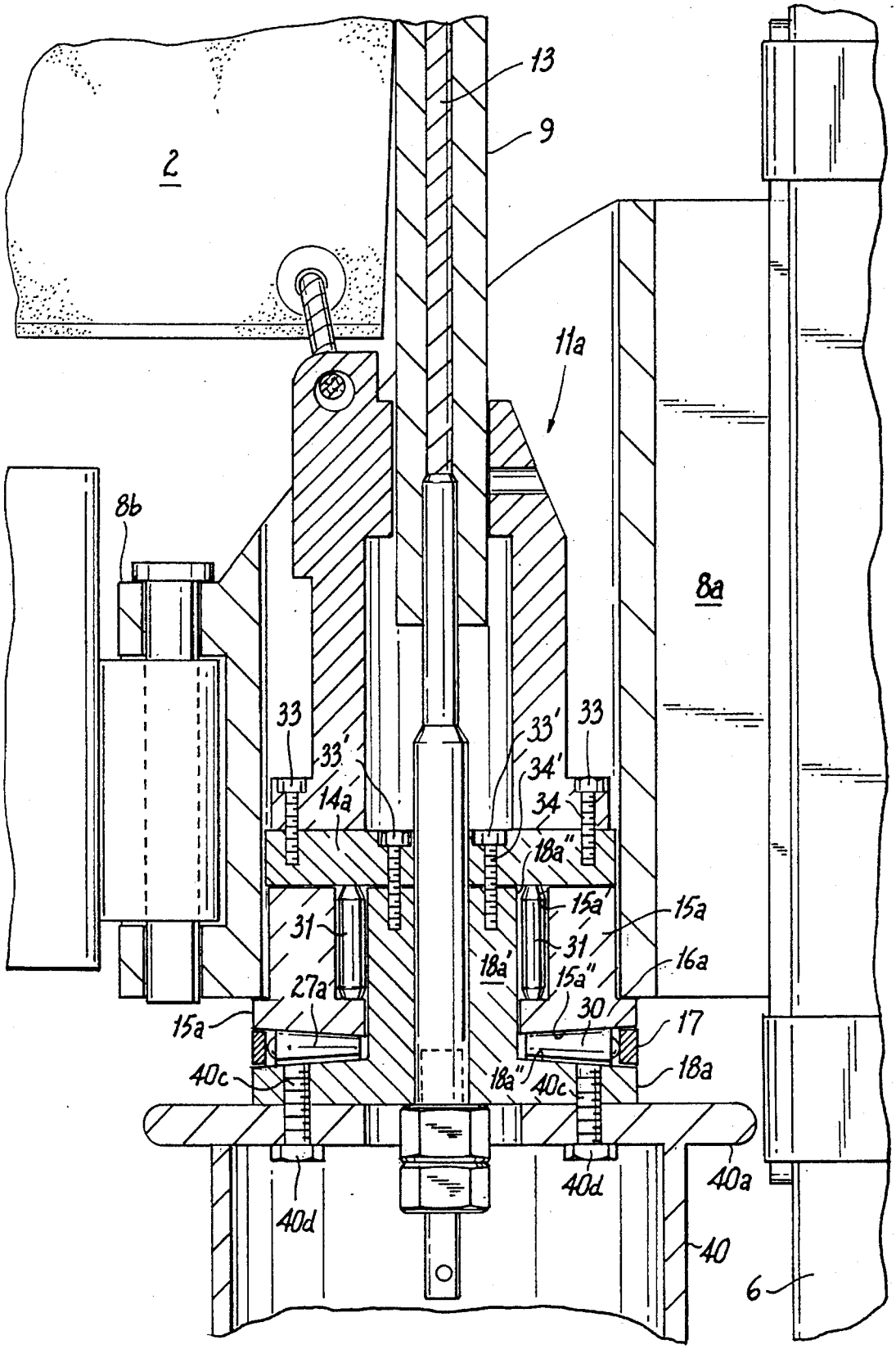
FIG. 11 is a close up cross sectional view of the lower bearing portion of the bearing assembly, as in FIG. 5.

As shown in FIGS. 5 and 11, concerning lower bearing portion 9*a*, spindle drum spool 40, about which the furling rope 41 is wound, rotates by the pull of furling rope 41, as shown in FIG. 10.

As further shown in FIG. 11, top plate 40*a* of spool 40 includes through holes 40*c* which have fasteners 40*d*, such as threaded bolts, to connect top plate 40 to rotatable inner bearing race plate 18*a*, which race plate 18*a* includes centrally located protrusion 18*a*' extending outward from bearing race plate 18*a*.

Bearing race plate 18*a* includes shoulder surface 18*a*" against which surface 18*a*" horizontally oriented tapered roller bearings 30 rotate axially between shoulder surface 18*a*" on one side and further shoulder surface 15*a*" of stationary cylindrical main housing 15*a*, to promote thrust. Tapered roller bearings 30 are held in radially extending positions within recesses 29*a*' between radially extending arms 29*a* of sunburst pattern roller cage 27*a* positioned between rotating bearing race plate 18*a* and plate 16*a* of stationary bearing housing 15*a*, attached to mast 6 by bracket 8*a* and boom 10 by bracket 8*b*. Sunburst pattern roller cage 27*a* further includes central ring portion 28*a* at the inner ends of radially extending arms 29*a*.

Concave outer heads of tapered roller bearings 30 contain spherical bearings 32 which also rotate against inside surface 17*a*' of freely rotatable ring 17*a*.

Stationary housing 15*a* is attached on one side by brackets 8*b* to boom 10 and on an opposite side by bracket 8*a* to mast 6. Boom 10 is rotatably attached to a lower end of mast 6.

Inside surface 15*a*' of stationary housing 15*a* forms a nest with outer surface 18*a*" of protrusion 18*a*' of rotatable race plate 18*a* for a plurality of vertically oriented needle roller rod bearings 31.

As further shown in FIGS. 5 and 11, attached at a top of protrusion 18*a*' of rotating bearing race plate 18*a* sits bearing plate 14*a* fastened to truncated conical extrusion cap 11*a* by fasteners 33 within bores 34 of bearing plate 14*a*. Bearing plate 14*a* connects to cylindrical protrusion 18*a*' of bearing race plate 18*a* by fasteners 33' within bores 34' of race plate 14*a*.

In operation, rotation of spool 40, inner bearing 18*a*, plate 14 and extrusion cap 11*a* also causes extrusion 9 and sail cable wire 13*a* to rotate therein, in conjunction with the winding or unwinding of spool 40 by halyard rope 41.

While lower bearing portion 7*a* is located at a bottom part of mast 6, as shown in FIG. 4, upper bearing portion 7 is attached at an opposite end of mast 6 to mast head 4 at the top 5 of mast 6.

As also shown in FIG. 4, upper bearing portion 7 includes upper and lower rotatable cylindrical hollow bearing plates 14, 18 surrounding stationary hollow member 15 and freely movable, rotatable outer race ring 17. Outer race ring 17 freely rotates as a collar about a circular array of horizontally placed and radially extending tapered roller bearings 30, placed with their tip ends 30*a*, at a center ring 28 of a sunburst pattern roller cage 27. Tapered roller bearings 30 rotate axially, and their concave head 30*b*, located opposite from each tip end 30*a*, at center ring 28 of which includes spherical roller balls 32, which rotate about inside edge 17' of circumferential outer race ring 17. Tapered roller bearings 30 rotate between plate portion 16 of stationary housing 15 and bearing race plate 18*a*.

As shown in FIG. 4, adjacent to top and bottom bearing race plate 18 is top sunburst pattern yoke roller cages 27, including centrally located inner ring 28.

As further shown in FIG. 4, radially extending arms 29, radiate uniformly out from respective inner ring 28, of roller cage 27, and each arm 29 of arms 29, are separable by recesses 29', of top roller cage 27, within which recesses 29, lie a plurality of rotatable tapered truncated roller bearings 30. Each tapered roller bearing 30 increases in width from an inner proximal end 30*a* to an outer distal end 30*b*. Outer distal ends 30*b* are concave to receive spherical roller bearings 32 therein.

Spherical roller bearings 32 rotate within concave surfaces of distal ends 30*b* of tapered roller bearings 30, as well as against inner surface 17', of respective of freely movable, rotatable outer race ring 17, also adjacent to top bearing race plate 18. Top outer race ring 17 rotates against top base plate 16, of top stationary cylindrical housing 15, opposite the side of top rotatable outer race ring 17 which rotates against bearing race plate 18.

Positioned within top cylindrical main housing 15, are a plurality of vertically oriented needle roller bearings 31, which bearings 31 rotate between an inside surface of top cylindrical housing 15, and an outside surface of smaller top cylindrical protrusion 18', extending from top bearing race plate 18. Opposite ends of the vertically oriented needle bearings 31 nest between top base plate 16, of top stationary main housing 15, at one end, and base bearing plate 14, attached to top and bottom truncated conical cap 11, within which top cap 11, extrusion 9 rotates.

As shown in FIG. 9, while extrusion 9 may be a hollow cylinder, preferably, extrusion 9 includes two molded vertically extending pieces 9*a*, 9*b* which each contain a concave surface, which concave surfaces, when joined together, form a nesting tube through which extends rotatable cable wire 13.

To facilitate the furling of main sail 2 to the furled position, about extrusion 9, the present invention utilizes twin bearing systems 7, 7*a* at both the top and bottom of extrusion 9, so that cable wire 13, which is attached to main sail 2, rotates with equal force at both the top and bottom ends.

Other modifications may be made to the sail furling mechanism of the present invention, without departing from the spirit and scope of the present invention, as noted in the appended claims.

I claim:

1. The sail furling apparatus comprising

A maritime sail furling apparatus which furls a sail comprising a rotating luff extrusion enclosing a cable wire therein, said cable wire attachable to a mast head of a mast of the sailboat, a pair of rotating bearing portions accommodating static and horizontal loads, said bearing portions disposed to rotating said luff extrusion and said cable wire, wherein the main sail is wound while the sailboat is under motor power;

each said bearing portion including a plurality of rotatable cylindrical hollow members, one middle member of said members being a freely rotatable roller cage enclosing a circular array of tapered roller bearings, said tapered roller bearings being rotatable with their respective tip ends at a center of a sunburst pattern of radiating arms of said roller cage, said tapered roller bearings rotatable axially, said tapered roller bearings having concave ends opposite said tip ends, each said concave ends having a spherical roller bearing rotating therein against a freely rotatable outer race ring, said outer race ring enclosing said roller cage therein.

2. The sail furling apparatus as in claim 1, wherein said cable wire is rotatable within a rotatable bearing race plate, which bearing race plate straddles said cable wire therein to facilitate rotation of said cable wire.

3. The said furling apparatus as in claim 1, wherein said roller cage includes a centrally located inner ring, the inside surface of which ring rotates freely about a cylindrical protrusion extending from said bearing race plate.

4. The said furling apparatus as in claim 1, wherein said arms radiate uniformly out from an inner ring of said roller cage, and said arms are separable by recesses within which recesses lie said rotatable tapered roller bearings, said tapered roller bearings increasing in width from an inner proximal end to an outer distal end, wherein said outer distal ends are concave to receive spherical roller bearings therein, wherein further said spherical roller bearings rotate both within respective concave surfaces of said tapered roller bearings, as well as against an inner surface of said rotatable outer race ring, adjacent to said bearing race plate.

5. The sail furling apparatus as in claim 1, wherein said outer race ring rotates against a base plate of a stationary cylindrical housing opposite the side of the outer race ring which rotates against said bearing race plate.

6. The sail furling apparatus as in claim 1 further comprising a stationary cylindrical main housing having vertically oriented needle roller bearings, said needle roller bearings rotatable between an inside surface of said cylindrical housing and an outside surface of a smaller cylindrical protrusion extending from said bearing race plate.

7. The sail furling apparatus as in claim 1, wherein said luff extrusion is hollow.

8. The sail furling apparatus as in claim 7, wherein said luff extrusion includes two molded vertically extending pieces, which said molded pieces each contain a concave surface, which concave surface, when joined together form a nesting tube through which extends said rotatable cable wire.

9. The sail furling apparatus as in claim 1, further comprising a rotatable spindle about which said spindle a furling rope sheet rotates, allowing the user to pull said furling rope sheet around said spindle in a friction reduced, stabilized manner.

10. The said furling apparatus as in claim 1, wherein one of said bearing portions is at a top of the mast and another of said bearing portions is at a bottom of the mast.

11. A maritime sail furling apparatus which furls a sail comprising:

a rotating luff extrusion enclosing a cable wire therein, said cable wire attachable to a mast head of a mast of a sailboat, a pair of rotating bearing portions accommodating static and horizontal loads, said bearing portions disposed to rotating said luff extrusion and said cable wire, wherein the main sail is wound while the sailboat is under motor power;

each said bearing portion including at least one rotatable cylindrical hollow member including a plurality of tapered bearings rotatable in a sunburst pattern therein against a freely rotatable ring.

* * * * *